US006848599B2

(12) United States Patent
Hammarth et al.

(10) Patent No.: US 6,848,599 B2
(45) Date of Patent: Feb. 1, 2005

(54) ADHESIVE CONTAINER AND METHOD OF FILLING

(75) Inventors: Mark Hammarth, Coram, NY (US); Stephen J. Lacivita, Foxboro, MA (US); Kevin J. May, Ball Ground, GA (US); Christopher Molina, Yorba Linda, CA (US); John S. Piwnica, Jr., East Islip, NY (US); Paul A. Raymond, Monmouth, NJ (US); Jonathan C. Waters, Warwick, RI (US)

(73) Assignee: Illinois Tool Works Inc., Glenview, IL (US)

( * ) Notice: Subject to any disclaimer, the term of this patent is extended or adjusted under 35 U.S.C. 154(b) by 114 days.

(21) Appl. No.: 10/226,023

(22) Filed: Aug. 22, 2002

(65) Prior Publication Data

US 2004/0035881 A1 Feb. 26, 2004

(51) Int. Cl.[7] ..... B65D 35/056
(52) U.S. Cl. ..... 222/105; 222/389; 222/464.2
(58) Field of Search ..... 222/105, 131, 222/386.5, 389, 527, 464.2

(56) References Cited

U.S. PATENT DOCUMENTS 2,744,662 A * 5/1956 Fletcher et al. ..... 222/95
3,240,399 A * 3/1966 Frandeen ..... 222/211
4,531,656 A * 7/1985 Nitchman et al. ..... 222/131
4,921,135 A * 5/1990 Pleet ..... 222/82
5,251,787 A * 10/1993 Simson ..... 222/95
5,318,207 A * 6/1994 Porter et al. ..... 222/387
5,398,852 A 3/1995 Lacy
5,526,957 A * 6/1996 Brown et al. ..... 222/94
5,899,362 A 5/1999 Moran
6,015,068 A 1/2000 Osgar et al.
6,488,991 B1 * 12/2002 Hunter et al. ..... 427/421
6,595,392 B2 * 7/2003 Barnett ..... 222/105

FOREIGN PATENT DOCUMENTS

EP 0 989 090 A1 3/2000

* cited by examiner

*Primary Examiner*—Gene Mancene
*Assistant Examiner*—Melvin A. Cartagena
(74) *Attorney, Agent, or Firm*—Dinsmore & Shohl LLP

(57) ABSTRACT

An adhesive container. The adhesive container includes a relatively rigid canister, a collapsible bag within the relatively rigid canister, the collapsible bag containing an adhesive, a propellant in a space between the outside of the collapsible bag and the inside of the relatively rigid canister, and a valve connected to the relatively rigid canister, the valve comprising an adhesive port in selective communication with the collapsible bag and a propellant port in selective communication space between the outside of the collapsible bag and the inside of the relatively rigid canister. The invention also involves a method of filling a bag-in-can container of adhesive.

32 Claims, 5 Drawing Sheets

ADHESIVE CONTAINER AND METHOD OF FILLING

BACKGROUND OF THE INVENTION

The present invention relates generally to containers for adhesive, and more particularly to a "bag-in-can" container for an adhesive, and a method of filling same.

Most adhesives are made of synthetic polymers. In water-based adhesives, the polymer latex and resin dispersion constituents are suspended using surfactants. The surfactants have very specific functions within the system and are vulnerable to changes in temperature, shear, pH, and chemical contamination.

Adhesives are designed to create a film which is tacky and resistant to contaminants that may degrade the tacky characteristic. The film must not soften and release its hold on the substrate under varying conditions of exposure to heat, water, and solvents.

The same properties which are necessary in the adhesive are problematic in delivering the adhesive using an applicator. The adhesive must be conveyed to the applicator. The surfaces of the application equipment, such as a spray gun, must remain free of adhesive build-up. If adhesive residue builds-up on the surfaces of the application equipment, the equipment may clog. The adhesive residue must then be removed manually by the user, which is time consuming and disruptive.

Most water-based adhesives are applied using air-assisted equipment. The application gun is designed with tandem valves so that both the air and product valves are open at the same time. The adhesive is supplied to the gun from either a low-pressure container or through a venturi siphon and is atomized by a high-pressure stream of air. The compressed air helps keep the tip clean. However, air-assisted applicators are limited to locations where compressed air is available. In addition, they are prone to maintenance problems and difficult equipment adjustments.

An airless solvent-based application system incorporates a needle valve to control the flow of the product to a tip designed to impart a particular pattern to the product as it exits the tip. In order to achieve this pattern, there is a space between the valve and the orifice. The space fills and swirls the product to obtain the spray pattern. When propellant is dissolved in the formula, the expansion in the tip space helps to clear the tip. However, for a simple-pressure pot system, there is no driving force to clear the tip when the valve is closed.

Some adhesives are not compatible with the propellants needed to deliver them. In order to make an aerosol application of incompatible adhesives and propellants, the components need to be kept separate.

The use of water-based products in aerosol packages (that is, self-contained, pre-pressurized containers) is known. Relatively small containers (less than 1 liter) with formulations which require complete segregation of the product from the propellants (such as "bag-in-can") are also known. However, this technology has apparently not been used successfully for an adhesive and/or in a package larger than one liter.

Therefore, there is a need for a "bag-in-can" adhesive container which can be used with an adhesive spray gun.

SUMMARY OF THE INVENTION

The present invention meets this need by providing an adhesive container for an adhesive applicator. The adhesive container includes a relatively rigid canister, a collapsible bag within the relatively rigid canister, the collapsible bag containing an adhesive, a propellant in a space between the outside of the collapsible bag and the inside of the relatively rigid canister, and a valve connected to the relatively rigid canister, the valve comprising an adhesive port in selective communication with the collapsible bag and a propellant port in selective communication with the space between the outside of the collapsible bag and the inside of the relatively rigid canister.

The adhesive container may optionally include a perforated tube sealed in the collapsible bag. The adhesive container may hold more than 1 liter of adhesive.

The relatively rigid canister may be a cylinder made of metal or plastic. Suitable metals include, but are not limited to, steel. Suitable plastics include, but are not limited to, polyethylene terephthalate.

The collapsible bag may be made of materials including but not limited to plastics, metals, and metallized films. Suitable plastics for the collapsible bag include, but are not limited to, polyethylene, polypropylene, and two layer films such as polyethylene/nylon films. Suitable metals include, but are not limited to, aluminum foils.

Suitable propellants include, but are not limited to, compressed gases, liquefied gases, and combinations thereof.

The valve may include a quick release air fitting, if desired. There may optionally be an outlet hose attached to the valve.

Alternatively, the adhesive container can include a relatively rigid canister, a collapsible bag within the relatively rigid canister, the collapsible bag containing a propellant, an adhesive in a space between the outside of the collapsible bag and the inside of the relatively rigid canister, and a valve connected to the relatively rigid canister, the valve comprising an adhesive port in selective communication with the space between the outside of the collapsible bag and the inside of the relatively rigid canister and a propellant port in selective communication with the collapsible bag.

DETAILED DESCRIPTION OF THE INVENTION

The adhesive container of the present invention is designed to separate the adhesive from the propellant while providing a pressurized container to deliver the adhesive. Some adhesives are not compatible with some propellants. In these situations, in order to make an aerosol, the components need to be kept separate. The bag-in-can concept is designed to use the propellant to squeeze the adhesive out of the bag.

Figure 1:
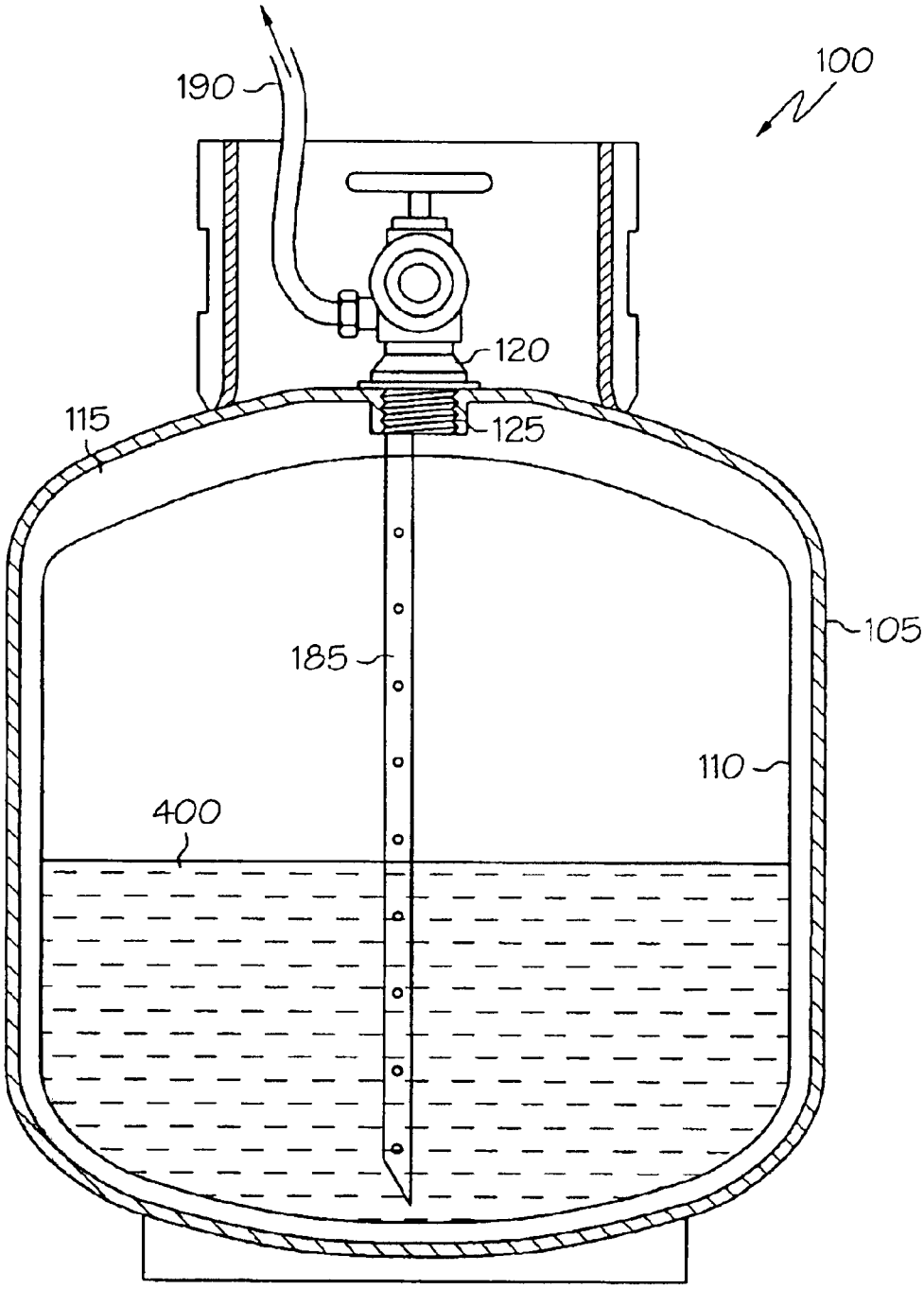
FIG. 1 is a cross-sectional view of one embodiment of an adhesive container of the present invention.

As shown in FIG. 1, the adhesive container 100 includes a relatively rigid canister 105. By "relatively rigid," we mean a material which is capable of containing sufficient pressure for the application. The canister 105 can be made of any material suitable for transporting pressurized products. For example, the canister 105 could be a steel or other metal cylinder, such as those designed for propane or refrigerant containment or a similar application. Alternatively, canisters made of plastics, including, but not limited to polyethylene terephthalate (PET), could be used in some applications. The canister should be able to withstand internal pressures of up to 500 psig or more, depending on the application.

Adhesive 400 is contained within collapsible bag 110 positioned within canister 105. Bag 110 can be made of any material suitable for the separation and containment of adhesive 400, including, but not limited to, plastics, such as polyethylene, polypropylene, and multilayer films, such as a polyethylene/nylon film, and metals, such as aluminum foils, and metallized films. The bag can be formed by welding two sheets of material together at the edges. Other methods of forming the bag could also be used, if desired. Typically, bag 110 is slightly oversized and shaped to conform to the inside of the canister 105.

Adhesive 400 can be any type of adhesive. Generally, the adhesive is of a type which will flow at ambient temperature. Adhesives which flow at higher temperatures could also be used under appropriate high temperature conditions. The adhesive is generally a water-based adhesive, although solvent-based adhesives could also be used. Suitable adhesives include, but are not limited to, contact and pressure sensitive adhesives.

Propellant 115 is charged between canister 105 and bag 110. Propellant 115 provides the differential pressure to drive adhesive 400 out of bag 110 when the appropriate valves have been opened. Propellant 115 can be gases which are liquefied, compressed, or a combination, depending on the pressures desired and any regulations which might be involved. Suitable propellants include, but are not limited to, flammable and non-flammable liquefied or compressed gases. The propellant is generally charged at a pressure in the range of about 20 to about 500 psig, typically about 50 to about 200 psig, more typically about 80 to about 120 psig.

Figure 2:
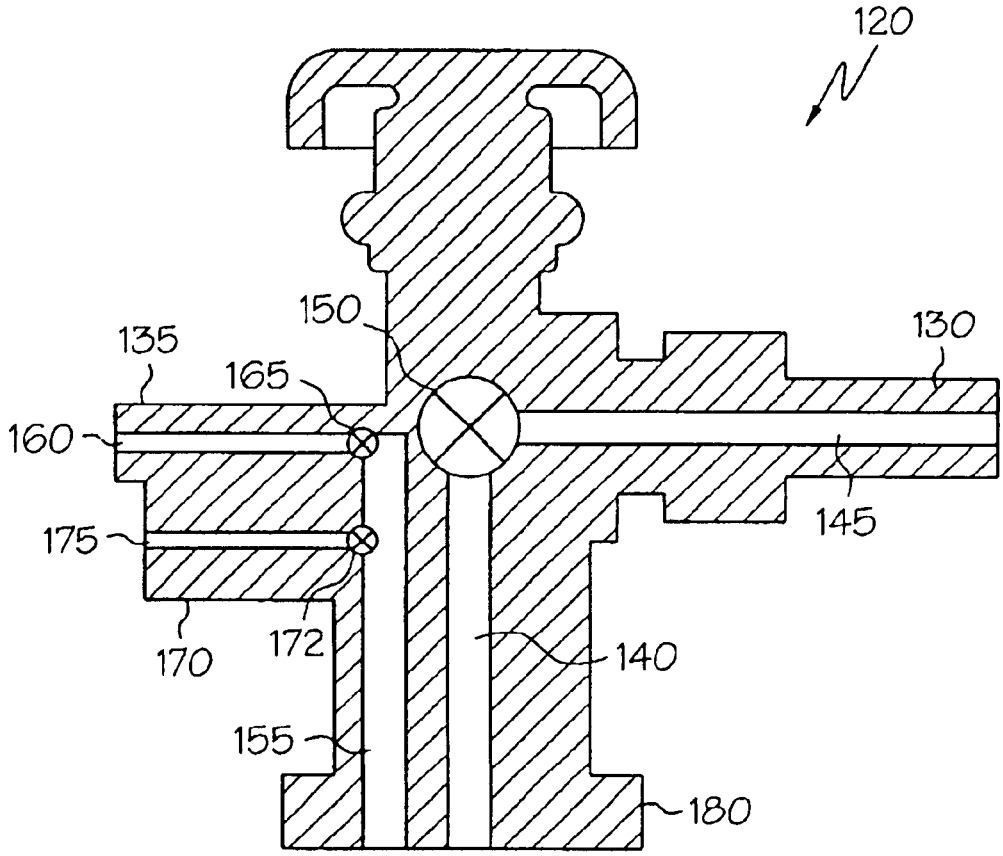
FIG. 2 is a cross-sectional view of one embodiment of the valve of the present invention.

A cylinder valve 120 is threaded onto a receiving port 125 of canister 105. As shown in FIG. 2, cylinder valve 120 has an adhesive port 130 and a propellant port 135. The adhesive port 130 can include a vertical adhesive channel 140 and a horizontal adhesive channel 145. An adhesive valve 150 controls the opening between the vertical adhesive channel 140 and the horizontal adhesive channel 145. One example of a valve which can be used for an adhesive valve 150 includes an actuator which raises and lowers a plug between the vertical and horizontal adhesive channels 140, 145. The bag 110 is filled with adhesive 400 through the adhesive port 130. Adhesive valve 150 is opened, allowing flow between the horizontal adhesive channel 145 and the vertical adhesive channel 140. Adhesive 400 flows through horizontal adhesive channel 145 and vertical adhesive channel 140 into bag 110.

The propellant port 135 can include a vertical propellant channel 155 and a horizontal propellant channel 160. There is a propellant valve 165 which controls the opening between the vertical propellant channel 155 and the horizontal propellant channel 160. One example of a valve which can be used for propellant valve 165 is a spring-type valve, such as a Schrader valve. The space between the outside of the bag 110 and the inside of the canister 105 is filled with propellant 115 through the propellant port 135. If a Schrader valve is used, a needle in the clamp mechanism actuates the Schrader valve allowing the propellant to flow into the space between the outside of the bag 110 and the inside of the canister 105. Propellant can emptied from the space using the same valve.

The cylinder valve 120 can also include a pressure relief port 170. Pressure relief channel 175 is connected to vertical propellant channel 155 by pressure relief valve 172. One example of a valve which can be used for pressure relief valve 172 is a spring-operated valve. The pressure relief valve 172 can have a pre-set pressure which will activate it.

Suitable valves for the adhesive valve, propellant valve, and pressure relief valve are well known to those of skill in the art.

Cylinder valve 120 can incorporate a quick-release air fitting 180 to allow for easy installation and removal of bags 110. The adhesive port 130 can have any suitable type of fitting, such as a National Pipe Swivel Mechanical (NPSM) fitting, so that it can be attached to an appropriate hose for connection to a sprayer.

Perforated tube 185 can be sealed or molded into bag 110 to act as a siphon for adhesive 400. Perforated tube 185 can be integrated into one of the seams of bag 110, if desired. Perforated tube 185 allows unrestricted access to the top of the canister 105. Perforated tube 185 provides a path for adhesive 400 to pass from bag 110 through the adhesive port 130 of cylinder valve 120, through hose 190 and into adhesive inlet 425 (see FIGS. 3 and 4). When the appropriate valves are opened, a differential pressure higher than atmospheric pressure allows the adhesive 400 to exit the bag 110. As the bag 110 collapses, the propellant 115 expands to fill the area left vacant by the adhesive 400.

The procedure for filling the adhesive container involves introducing the adhesive into the bag through the adhesive port. The propellant port can be put under vacuum while the adhesive is filled, if desired. After the bag has been filled with the desired amount of adhesive, the adhesive port can be cleaned to ensure that the adhesive valve is free of adhesive and closed. The propellant is filled through the propellant port, which is then closed. The adhesive container is then ready for use. To ensure that the adhesive container contains the appropriate amount of adhesive and propellant, the filling can be done automatically using preset adhesive and propellant weight set points. The entire fill process can be automated, if desired.

The adhesive container can be reused after the adhesive has been dispensed. The bag will likely need to be replaced, although it could also be reused in some situations, if desired. After the bag is placed in the canister and connected to the valve, adhesive and propellant could then be charged into the adhesive container as discussed above, and it would be ready for reuse.

Alternatively, the adhesive and the propellant could be reversed in the container. In this arrangement, the propellant is contained in the collapsible bag while the adhesive is in the space between the outside of the collapsible bag and the inside of the relatively rigid canister. The propellant would expand inside the bag, forcing the adhesive out of the container. The bag would be designed to withstand the pressures involved. The valve has an adhesive port in selective communication with the space between the outside of the collapsible bag and the inside of the relatively rigid canister and a propellant port in selective communication with the collapsible bag. The perforated tube could be placed into the space between the outside of the collapsible bag and the inside of the relatively rigid canister to allow flow of the adhesive out of the space. The pressure relief valve would be in selective communication with the collapsible bag.

When the relatively rigid canister is made of plastic in this alternate arrangement, the use of a water-based adhesive would not rust the canister.

Figure 3:
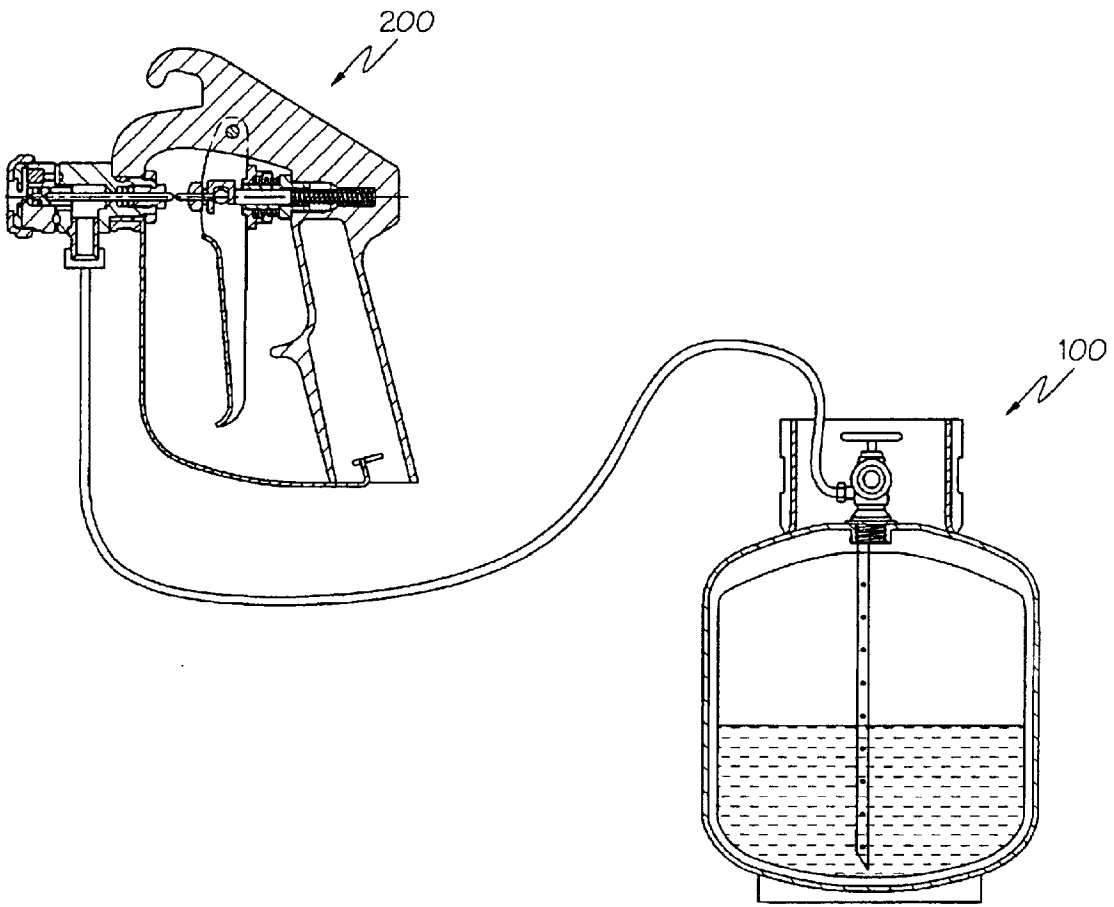
FIG. 3 is a schematic of one embodiment of an adhesive application system using the adhesive container of the present invention.

FIG. 3 shows one embodiment of the adhesive container of the present invention in an airless application system 10, such as that disclosed more fully in copending application Ser. No. 10/643,107, filed concurrently herewith, and which is hereby incorporated by reference. The airless application system 10 includes the adhesive container 100 connected to an adhesive sprayer 200. The adhesive sprayer 200 is shown in more detail in FIG. 4.

Figure 4:
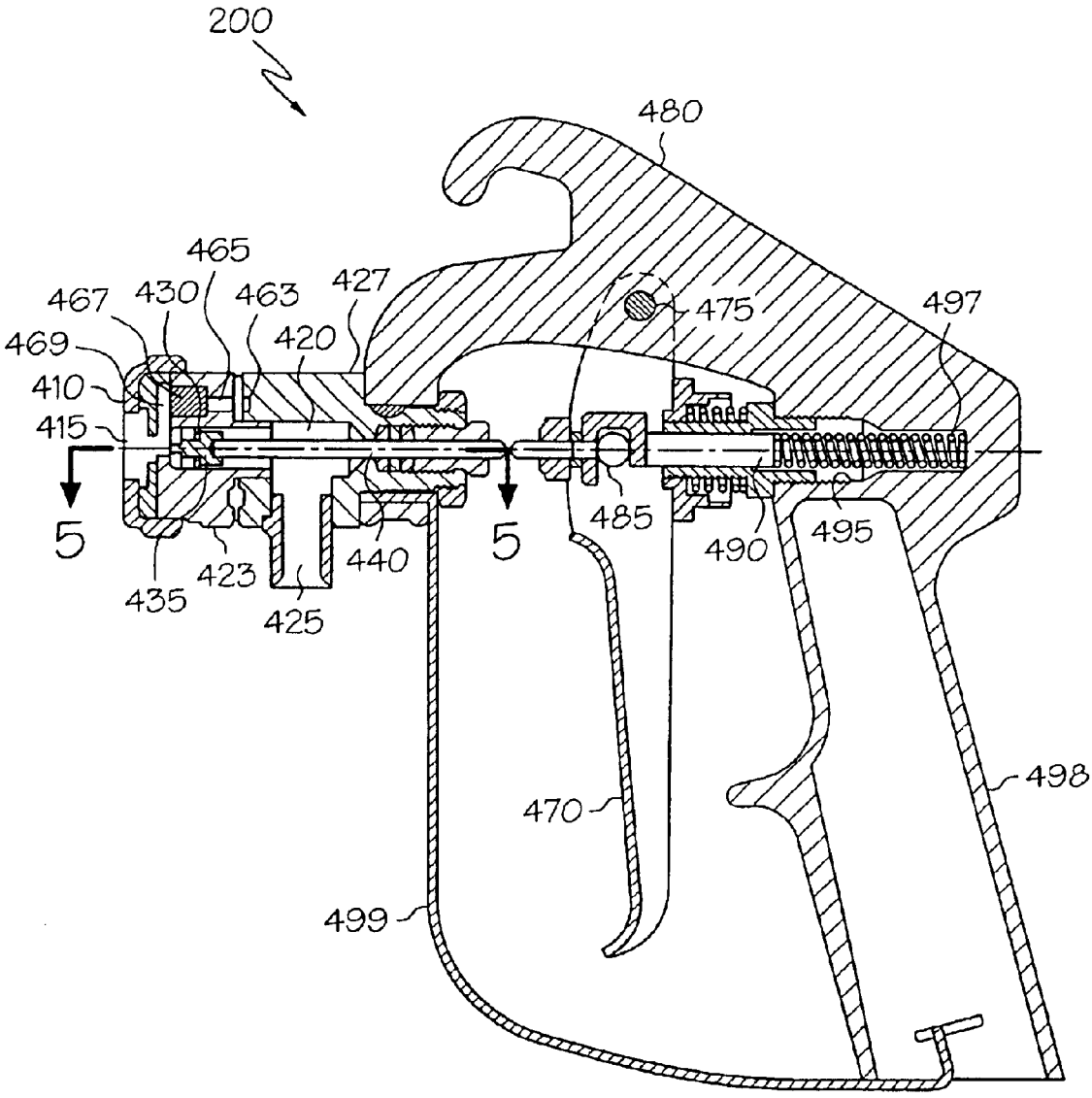
FIG. 4 is a cross-sectional side view, partially in phantom, of one embodiment of a spray gun, shown at rest with the trigger not depressed.
Figure 5:
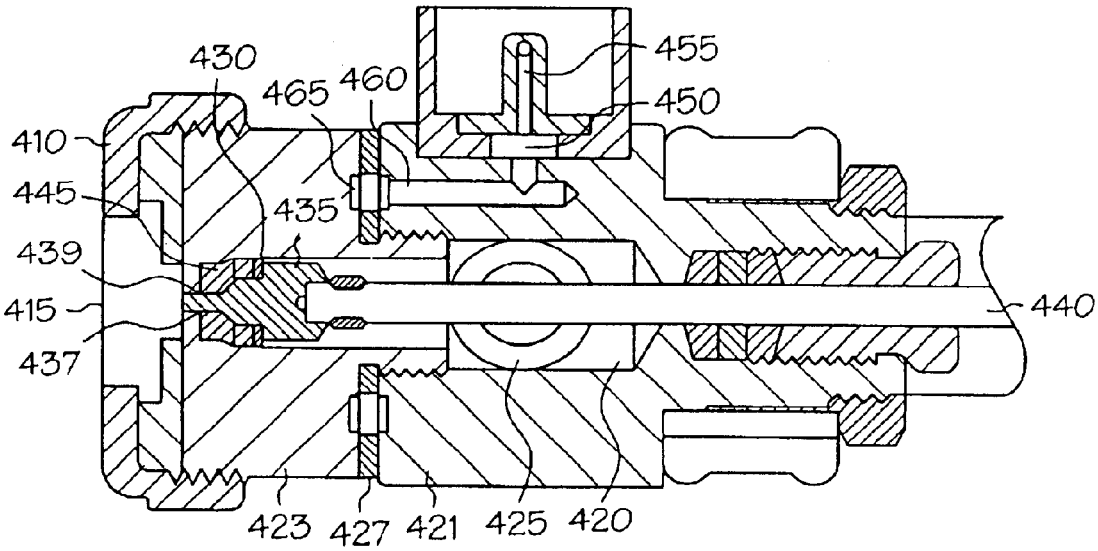
FIG. 5 is a cross-sectional top view of the valve assembly of FIG. 4 taken along the line A—A.

FIGS. 4 and 5 show one embodiment of an adhesive sprayer 200 which can be used in conjunction with the adhesive container of the present invention. Sprayer 200 includes sprayer tip 410 with aperture 415 therethrough for spraying or dispensing adhesive 400 and cleaning solution 500. The sprayer 200 further includes adhesive chamber 420. Adhesive chamber 420 receives the adhesive 400 from adhesive inlet 425. Adhesive inlet 425 would be connected to the adhesive container 100. Adhesive chamber outlet 430 is selectively opened and closed by slider 435 and shaft 440. Slider 435 includes needle 437. Shaft 440 is attached to slider 435, and slider 435 reciprocates within adhesive chamber 420. When shaft 440 is in the forward position shown in FIG. 4, needle 437 is inserted into opening 439 and slider 435 seats against seat 445, closing adhesive chamber outlet 430. Adhesive 400 is blocked from flowing and is not dispensed from sprayer tip 410. When the reciprocation of slider 435 opens adhesive chamber outlet 430, slider 435 is withdrawn from seat 445 and needle 437 is withdrawn from opening 439. Adhesive 400 flows around slider 435 and needle 439 and is dispensed from sprayer tip 410.

Cleaning solution 500 is introduced through cleaning solution chamber outlet 450. Any suitable cleaning solution could be used, such as the aerosol solution disclosed in copending application Ser. No. 10/225,874, filed concurrently herewith, and which is hereby incorporated by reference. Cleaning solution chamber outlet 450 is selectively opened and closed by needle valve 455. When needle valve 455 is closed as shown in FIG. 5, cleaning solution 500 cannot flow through cleaning solution chamber outlet 450. When needle valve 455 is opened by inserting it into a valve on the top of an aerosol can (not shown) of cleaning solution, cleaning solution 500 flows through needle valve 455, channel 460, and into annular channel 463. Cleaning solution 500 enters at the side of annular channel 463 and exits at the top of the annular channel 463 through check valve channel 465. It then flows through check valve 467, down through groove 469, through opening 439, and out through spray tip 410.

Adhesive 400 will fill groove 469. A check valve 467 is placed in check valve channel 465 to prevent adhesive 400 from being pushed into any other channels or chambers. The presence of check valve 467 adjacent to spray tip 410 minimizes the amount of cleaning solution required to displace the adhesive 400.

The design allows the cleaning solution 500 to be injected along the side of the gun. The direction of flow is changed so that the check valve can be placed above the needle helping to evacuate latent adhesive behind the fluid tip.

The design also allows for easy assembly of the sprayer. By including annular channel 463, channel 460 and check valve channel 465 do not have to line up during assembly. As shown in FIGS. 4 and 5, channel 460 is in the inlet body 421, while the check valve channel 465 is in check valve body 423. Without the annular channel 463, simply tightening the assembly too much or not enough could cause misalignment of channel 460 and check valve channel 465, preventing or restricting flow of the cleaning solution. If desired, there can be a gasket 427 between inlet body 421 and check valve body 423. The gasket 427 has a center hole to allow the flow of adhesive 400 and a series of smaller holes around the circumference to allow flow of the cleaning solution 500 through the annular channel 463. Gasket 427 prevents adhesive 400 and cleaning solution 500 from flowing out of their designated paths.

Trigger 470 is journaled to pivot about pivot point 475 on body 480 of sprayer 200. Trigger 470 includes boss 485 at a central upward location thereon which drives valve drive shaft 490. Valve drive shaft 490 is received within aperture 495 in body 480 and is biased by spring 497 within aperture 495 which urges valve drive shaft 490, in the absence of other forces (such as manual pressure by the user), to the position shown, wherein the adhesive 400 is blocked from flowing by slider 435. Valve drive shaft 490 is connected to shaft 440 so that shaft 440 moves in concert with valve drive shaft 490.

When trigger 470 is depressed toward handle 498, shaft 440 withdraws slider 435 from seat 445 and needle 437 from opening 439, opening adhesive chamber outlet 430. Adhesive 400 flows through adhesive chamber 420, around slider 435 and needle 437 and out through sprayer tip 410. When the trigger is released, slider 435 moves forward to seat against seat 445 and needle 437 enters opening 439, closing adhesive chamber outlet 430.

With the adhesive chamber outlet 430 closed, the valve of a container of cleaning solution (not shown) is contacted with needle valve 455. Needle valve 455 opens, allowing the cleaning solution 500 to flow through needle valve 455, into chamber 460, through annular channel 463, check valve channel 465, check valve 467, groove 469, and out through sprayer tip 410. Cleaning solution 500, cleans and wets everything it comes into contact with. Cleaning solution 500 can be under pressure, which allows the check valve 470 to open and remain open until the needle valve 455 is disengaged from the cleaning solution container.

The sprayer may optionally include a trigger guard 499 to prevent the sprayer from being activated accidentally.

Although one embodiment of an adhesive sprayer has been described in detail, the adhesive container of the present invention is not limited to use with this specific type of adhesive sprayer. The adhesive container of the present invention can be used with any type of adhesive sprayer, such as are well known to those of skill in the art.

Thus, the present invention provides a portable, self-contained supply of adhesive. The mobility of the adhesive container is only limited by the weight of the product and package. In addition, it can be used without the addition of ingredients that are environmentally or user unfriendly (volatile organic compounds, flammable, etc.).

While certain representative embodiments and details have been shown for purposes of illustrating the invention, it will be apparent to those skilled in the art that various changes in the compositions and methods disclosed herein may be made without departing from the scope of the invention, which is defined in the appended claims.

What is claimed is:

1. An adhesive container comprising:

a relatively rigid canister;

a collapsible bag within the relatively rigid canister, the collapsible bag containing an adhesive;

a propellant in a space between the outside of the collapsible bag and the inside of the relatively rigid canister;

a valve receiving port on the relatively rigid canister; and a valve positioned in the valve receiving port on the relatively rigid canister, the valve comprising an adhesive port in selective communication with the collapsible bag and a propellant port in selective communication with the space between the outside of the collapsible bag and the inside of the relatively rigid canister.

2. The adhesive container of claim 1 further comprising a perforated tube sealed in the collapsible bag.

3. The adhesive container of claim 2 wherein the perforated tube is molded in the collapsible bag.

4. The adhesive container of claim 1 wherein the relatively rigid canister is a cylinder made of a material selected from metals and plastics.

5. The adhesive container of claim 4 wherein the cylinder is made of steel.

6. The adhesive container of claim 4 wherein the cylinder is made of polyethylene terephthalate.

7. The adhesive container of claim 1 wherein the collapsible bag is made of a material selected from plastics, metals, or metallized films.

8. The adhesive container of claim 7 wherein the collapsible bag is made of a plastic selected from polyethylene or polypropylene.

9. The adhesive container of claim 7 wherein the collapsible bag is made of a multilayer film.

10. The adhesive container of claim 9 wherein the multilayer film is a polyethylene/nylon film.

11. The adhesive container of claim 1 wherein the adhesive is selected from contact adhesives or pressure sensitive adhesives.

12. The adhesive container of claim 1 wherein the valve further comprises a pressure relief port in selective communication with the space between the outside of the collapsible bag and the inside of the relatively rigid canister.

13. The adhesive container of claim 1 wherein the valve further comprises a quick release air fitting.

14. The adhesive container of claim 1 further comprising an outlet hose attached to the valve.

15. The adhesive container of claim 1 wherein the collapsible bag contains more than 1 liter of adhesive.

16. The adhesive container of claim 1 wherein the propellant is selected from liquefied gases, compressed gases, or combinations thereof.

17. The adhesive container of claim 1 wherein the propellant in the space between the collapsible bag and the relatively rigid canister is under a pressure of between about 20 and about 500 psig.

18. The adhesive container of claim 1 wherein the valve includes an adhesive port having a first position prevention adhesive flow into and out of the collapsible bag and a second position allowing adhesive flow into and out of the collapsible bag, and a propellant port having a first position preventing propellant flow into and out of the space between the outside of the collapsible bag and the inside of the relatively rigid canister and a second position allowing propellant flow into and out of the space between the outside of the collapsible bag and the inside of the relatively rigid canister.

19. An adhesive container comprising:

a relatively rigid canister;

a collapsible bag within the relatively rigid canister, the collapsible bag containing a propellant;

an adhesive in a space between the outside of the collapsible bag and the inside of the relatively rigid canister;

a valve receiving port on the relatively rigid canister; and a valve positioned in the valve receiving port on the relatively rigid canister, the valve comprising an adhesive port in selective communication with the space between the outside of the collapsible bag and the inside of the relatively rigid canister and a propellant port in selective communication with the collapsible bag.

20. The adhesive container of claim 19 wherein the relatively rigid canister is a cylinder made of a material selected from metals and plastics.

21. The adhesive container of claim 19 wherein the collapsible bag is made of a material selected from plastics, metals, or metallized films.

22. The adhesive container of claim 21 wherein the collapsible bag is made of a plastic selected from polyethylene or polypropylene.

23. The adhesive container of claim 21 wherein the collapsible bag is made of a multilayer film.

24. The adhesive container of claim 23 wherein the multilayer film is a polyethylene/nylon film.

25. The adhesive container of claim 19 wherein the adhesive is selected from contact adhesives or pressure sensitive adhesives.

26. The adhesive container of claim 19 wherein the valve further comprises a pressure relief port in selective communication with the collapsible bag.

27. The adhesive container of claim 19 wherein the valve further comprises a quick release air fitting.

28. The adhesive container of claim 19 further comprising an outlet hose attached to the valve.

29. The adhesive container of claim 19 wherein the propellant is selected from liquefied gases, compressed gases, or combinations thereof.

30. The adhesive container of claim 19 wherein the propellant is under a pressure of between about 20 and about 500 psig.

31. The adhesive container of claim 19 wherein the valve includes an adhesive port having a first position preventing adhesive flow into and out of the space between the outside of the collapsible bag and the inside of the relatively rigid canister and a second position allowing adhesive flow into and out of the space between the outside of the collapsible bag and the inside of the relatively rigid canister, and a propellant port having a first position preventing propellant flow into and out of the collapsible bag and a second position allowing propellant flow into and out of the collapsible bag.

32. An adhesive container comprising:

a relatively rigid canister;

a collapsible bag within the relatively rigid canister, the collapsible bag containing an adhesive;

a perforated tube is molded in the collapsible bag;

a propellant in a space between the outside of the collapsible bag and the inside of the relatively rigid canister; and a valve connected to the relatively rigid canister, the valve comprising an adhesive port in selective communication with the collapsible bag and a propellant port in selective communication with the space between the outside of the collapsible bag and the inside of the relatively rigid canister.

* * * * *